US008201623B2

(12) United States Patent
O'Brien

(10) Patent No.: US 8,201,623 B2
(45) Date of Patent: Jun. 19, 2012

(54) REDUCED WEAR POSITION INDICATING SUBTERRANEAN TOOL

(75) Inventor: Robert S. O'Brien, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 292 days.

(21) Appl. No.: 12/554,303

(22) Filed: Sep. 4, 2009

(65) Prior Publication Data

US 2011/0056678 A1 Mar. 10, 2011

(51) Int. Cl.
*E21B 23/02* (2006.01)

(52) U.S. Cl. ..... 166/237; 166/332.1; 166/334.1; 166/323

(58) Field of Classification Search ..... 166/237, 166/240, 321, 323, 332.1, 334.1
See application file for complete search history.

(56) References Cited

U.S. PATENT DOCUMENTS

| | | | | |
|---|---|---|---|---|
| 3,061,010 | A * | 10/1962 | Conrad et al. | 166/64 |
| 3,071,192 | A * | 1/1963 | Raulins | 166/217 |
| 4,614,233 | A | 9/1986 | Menard | |
| 5,092,402 | A | 3/1992 | Perricone et al. | |
| 5,636,694 | A | 6/1997 | Mireles, Jr. et al. | |
| 5,941,306 | A * | 8/1999 | Quinn | 166/120 |
| 7,284,606 | B2 | 10/2007 | Coronado | |

FOREIGN PATENT DOCUMENTS

WO WO 2007003894 A2 * 1/2007

OTHER PUBLICATIONS

Coronado, Martin P., et al., "Advanced Openhole Completions Utilizing a Simplified Zone Isolation System", SPE 77438, Sep. 2002, 1-11.

Hoffman, C.R., "One-Trip Sand-Control /Liner Hanger/Big-Bore Completions System", SPE 101086, Sep. 2008, 1-.

Nazzal, Greg, et al., "Development, Testing and Filed History of a True One Trip Casing Exit System", SPE 35662, May 1996, 135-144.

* cited by examiner

*Primary Examiner* — William P Neuder
*Assistant Examiner* — Richard Alker
(74) *Attorney, Agent, or Firm* — Steve Rosenblatt

(57) ABSTRACT

A positioning tool engages a profile with retaining members such as dogs so that a pulling force can be applied for a predetermined time as a signal that the tool is at the proper location. The time delay is a fluid system that drives fluid through a narrow restriction. The restriction is variable to allow unloading of the resistance from the fluid system while the dogs are still adequately supported. As a result the dogs are released from the profile without regional overstressing. A lock can prevent the tool from resetting to limit its use to locating at a single location. The lock holds the hydraulic system in a defeated position so that even if the dogs engage another profile when locked they will immediately exit that profile.

24 Claims, 2 Drawing Sheets

REDUCED WEAR POSITION INDICATING SUBTERRANEAN TOOL

FIELD OF THE INVENTION

The field of the invention is an indicating tool that lands one or more dogs in a recess to give a surface signal of its location and more particularly features of such tools that protect the dogs that engage the downhole recess as the tool is released after giving the surface signal indication.

BACKGROUND OF THE INVENTION

Position indicating tools for subterranean use are illustrated in U.S. Pat. No. 7,284,606. The elements of this tool are a series of dogs that find a groove generally after passing that groove and being brought back up into engagement. Once the dogs engage a force is placed on the string. This force moves the string up against resistance of fluid that is forced from one reservoir to another through a restriction orifice. The orifice provides a time delay that is sufficiently long to realize at the surface that the tool is properly located before a release of the stress on the dogs in the groove starts to happen. The idea is that the delay is long enough to allow surface personnel to reduce the pulling force so that at the time there is a release the applied force on the dogs is also reduced.

In field applications there still seemed to be severe wear on the dogs causing them to have to be replaced at more frequent intervals than was desired. One of the problems was that surface personnel would forget or react too slowly in reducing the applied force at the time of release so that no decrease in the wear rate of the dogs could be achieved. Even if the applied pulling load was reduced at the time of release, there was still an issue of the hydraulic system still operating to force fluid through the orifice as relative movement between a mandrel being pulled on and the dogs still in the groove continued to stress the dogs as progressively less contact area supported the dogs in the surrounding groove as well as on the mandrel at a location under the dogs. Despite the reduced pulling force, the progressive decrease in contact support area on various locations on the dog as it was being released, increased those localized stresses. As a result pieces of the dog were still subject to overstress to the point where pieces of the dog near such overstressed local regions would simply be sheared off. This required frequent maintenance to the dogs generally by a replacement of parts.

Another issue with the prior tool was that if there were many indicating recesses in the wellbore, there was a possibility that the tool would engage them on the way out and to get the tool to release the same metering procedure as initially undertaken would need to be repeated. This could take time and that results in additional expense to the operator.

Other tools in the past that would only shift a given downhole sliding sleeve once and could not re-latch if the sleeve had been shifted close enough to a travel stop are shown in U.S. Pat. No. 5,636,694. However, there was no mechanism on the tool itself that kept it from re-engaging after a given sleeve shift. What prevented this tool from re-engaging a sleeve it had just shifted was that the sleeve in question had moved to the desired position. This tool would still engage other similarly configured sleeves as it had a reset capability.

The present invention improves on the design of the position locating tool in U.S. Pat. No. 7,284,606 and modifies it in several respects. It unloads the hydraulic system while the dogs are still sufficiently supported to minimize the shearing issues with the dogs. The unloading occurs with the dogs still sufficiently supported so that stress will not intensify at the time of release to the extent that localized failure can occur. An optional feature allows the tool to be a single time operation by disabling the metering system by virtue of holding the shifted position of parts after a single use so that the metering system is disabled and the tool is prevented from resetting. While the dogs can go into other recesses in the disabled condition, the metering system is not operative and the dogs will simply jump back out of any such grooves when a minimal uphole force is applied to the tool body on the way out of the subterranean location. These and other aspects of the present invention will become more apparent to those skilled in the art from a review of the description of the preferred embodiment and the associated drawings while recognizing that the full scope of the invention is given by the associated claims.

SUMMARY OF THE INVENTION

A positioning tool engages a profile with retaining members such as dogs so that a pulling force can be applied for a predetermined time as a signal that the tool is at the proper location. The time delay is a fluid system that drives fluid through a narrow restriction. The restriction is variable to allow unloading of the resistance from the fluid system while the dogs are still adequately supported. As a result the dogs are released from the profile without regional overstressing. A lock can prevent the tool from resetting to limit its use to locating at a single location. The lock holds the hydraulic system in a defeated position so that even if the dogs engage another profile when locked they will immediately exit that profile.

DETAILED DESCRIPTION OF THE PREFERRED EMBODIMENT

Figure 1:
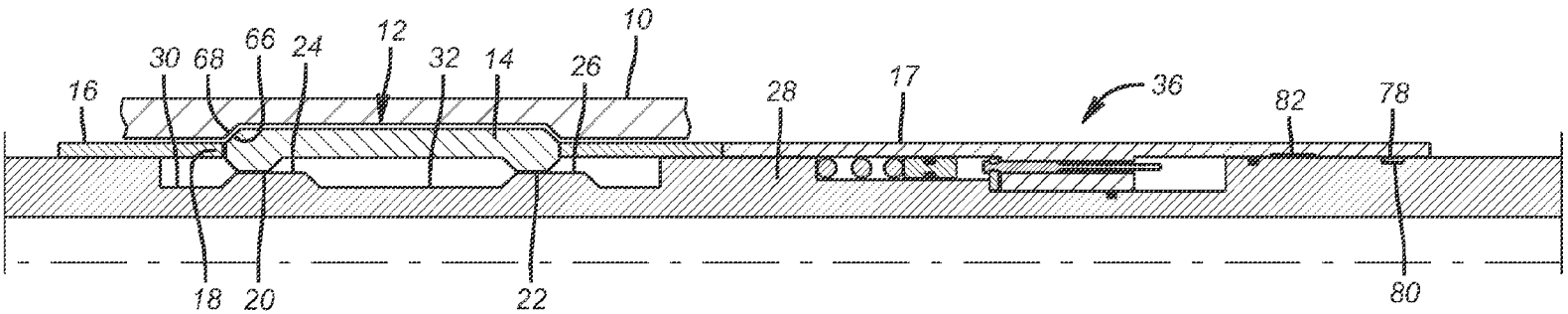
FIG. 1 is a half section of the tool in the position where a pulling force is started with the dog in the locating groove.
Figure 2:
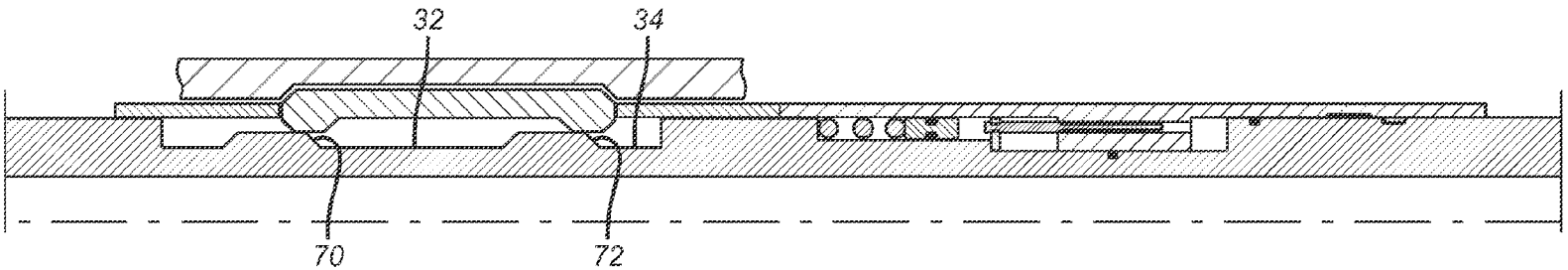
FIG. 2 is the view of FIG. 1 with the hydraulic system about to release while the dog is still adequately supported in the locating groove.
Figure 3:
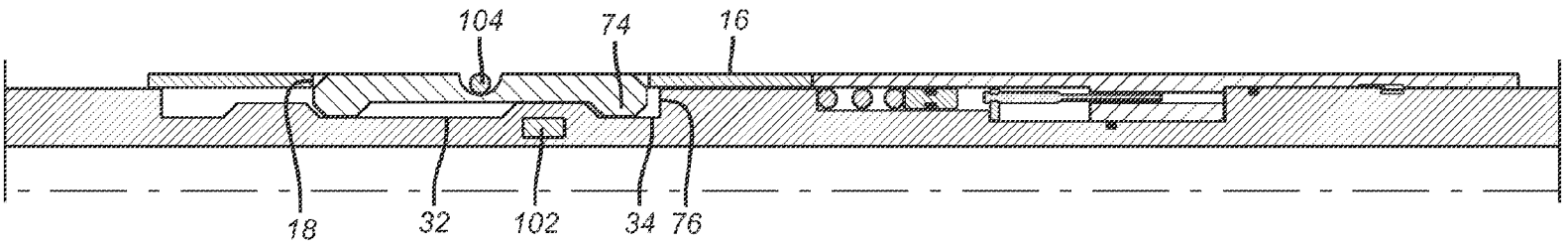
FIG. 3 is the view of FIG. 2 with the dog released and the relative movement of the components optionally locked.

As shown in FIG. 1 a subterranean string 10 has one or more locating grooves 12 that accept one or more dogs 14 that extend from an outer dog housing 16 through one or more openings 18. The dogs 14 are biased outwardly and retained from coming out of the outer housing 16 in a way that is known in the art and described in U.S. Pat. No. 7,284,606. Dogs 14 have internally oriented raised surfaces 20 and 22 that can reside in contact with surfaces 24 and 26 for run in. Surfaces 24 and 26 are located on mandrel 28. In the run in position, if an obstacle is encountered running downhole, the dogs 14 move against a bias (not shown) to duck into recesses 30 and 32 so that the obstruction can be cleared. At the same the mandrel 28 can move down taking housing 17 with it as will be explained below. After the obstruction is cleared the dogs 14 go back to the FIG. 1 position. As seen in FIGS. 2 and 3 the dogs 14 retract toward surfaces 32 and 34 after the uphole pulling occurs on mandrel 28 for a predetermined time as will be fully explained below.

Figure 4:
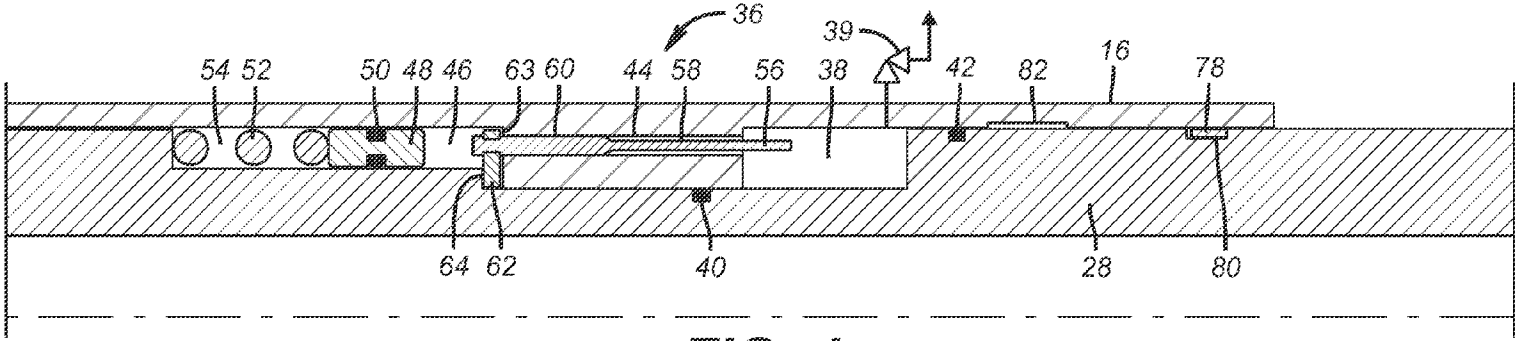
FIG. 4 is the view of FIG. 1 but enlarged to show the tapered pin of the hydraulic system in the in initial position.
Figure 5:
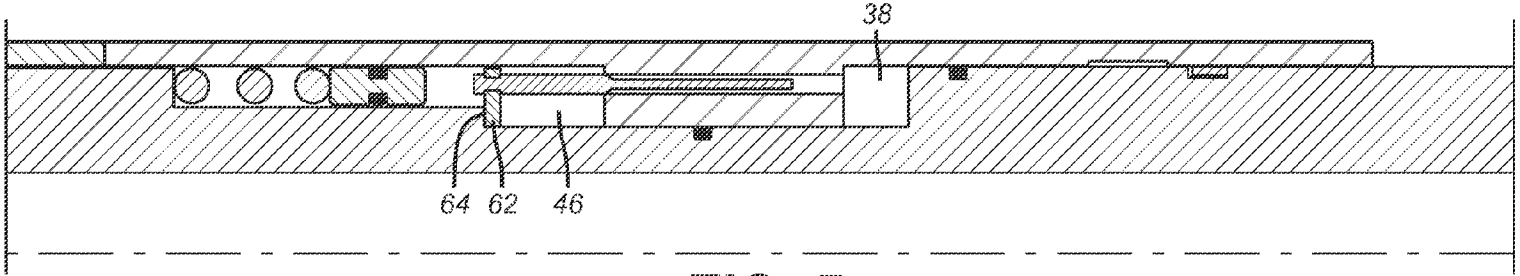
FIG. 5 is the view of FIG. 2 with the tapered pin of the hydraulic system having the larger portion just coming out of the bore.
Figure 6:
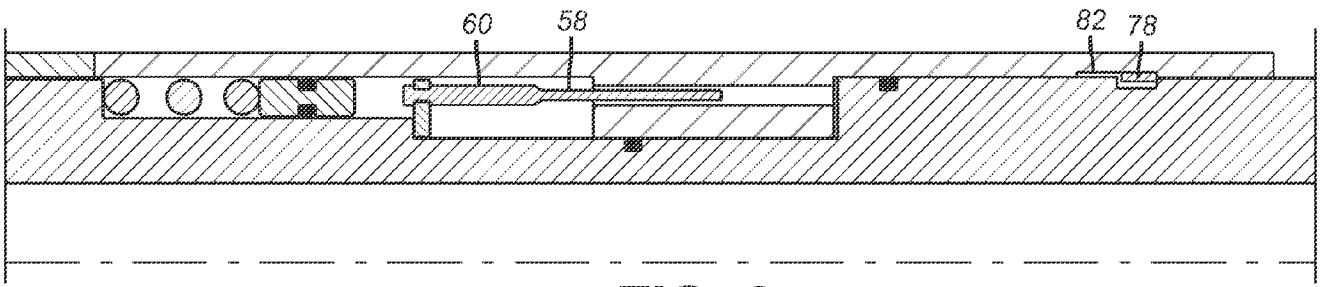
FIG. 6 is the view of FIG. 3 with the smaller portion of the tapered pin out of the restricted bore in the hydraulic system.

The hydraulic system 36 can be seen in a larger scale in FIGS. 4-6. Mandrel 28 and outer housing 16 define a first variable volume chamber 38 that has seals 40 and 42. Passage 44 leads to variable volume chamber 46 that is in part defined by a floating piston 48 having a seal or seals 50. A spring 52 pushes on piston 48 and is located in chamber 54. The purpose of biased piston 48 is to act as the thermal expansion compensator for the hydraulic fluid in the cavities 38 and 46 and the passage 44 that connects them. Pin 56 has at least two different diameters 58 and 60 best seen in FIG. 6. A ring 62 is attached to an end of the pin 56 at diameter 60 and is designed to engage a shoulder 64 as a travel stop when mandrel 28 is pulled uphole for the metering function. When running in, ring 62 also rests on shoulder 63 to take down housing 17 with mandrel 28 so that housings 17 and 16 separate until the dogs 14 clear an obstruction when running in and the dogs 14 can then pop out under bias (not shown) to put the housings 16 and 17 back together again. With the dogs 14 landed in recess 12 and an upward force put on the mandrel 28 the volume of chamber 38 decreases while the volume of chamber 46 increases as hydraulic fluid has to pass through passage 44.

The metering process is illustrated in a comparison of FIGS. 1-3. In FIG. 1 the dogs 14 are in the recess 12 and fully supported at surfaces 20 and 22 such that the uphole corner 66 of the dogs 14 is firmly in the recess 12 and against surface 68. As the pulling force is applied from the surface to the mandrel 28, it starts coming up. There is resistance to mandrel 28 rising as hydraulic fluid has to be forced from cavity 38 into cavity 46 through passage 44, which at the time has the larger diameter 60 still in bore 44 to provide heightened resistance to fluid flow. This is intended so as to give time for surface personnel to realize that the proper location has been reached. Thus far the metering operation is unchanged from the operation of the previous design in U.S. Pat. No. 7,284,606, but what happens next is very different.

FIG. 2 shows the position of the dogs 14 at the onset of release of the dogs 14 from the recess 12. Surfaces 20 and 22 are still substantially supported to the tune of preferably at least 50% of their surface area, off of surfaces 24 and 26. The dogs have yet to start inward retraction from the recess 12 because surfaces 24 and 26 are still precluding that movement. Accordingly, there is still unchanged contact between the upper end 66 of the dogs 14 and the corresponding surface 68 in the recess 12. Looking at FIG. 5 at this time the very end of the larger diameter 60 in bore 44 to mark the imminent disappearance of resistance to fluid flow through passage 44, which will happen as soon as the larger diameter portion 60 exits bore 44 leaving only the smaller diameter 58 in bore 44 which offers, relatively, very little resistance to flow through passage 44 from chamber 38 to chamber 46.

When the larger diameter portion 60 comes out of passage 44 the mandrel 28 can rapidly accelerate uphole. As the mandrel 28 accelerates uphole it is no longer pushing the uphole segment 66 of the dogs 14 against surface 68 of the recess 12. Similarly, surfaces 32 and 34 rapidly present themselves opposite surfaces 20 and 22. Comparing this to the operation of the prior tool, the metering system in the prior tool maintained resistance to uphole movement of mandrel 28 as surfaces 22 and 24 rode off the end of surfaces 24 and 26 and down the respective adjacent ramps 70 and 72. This tended to break off pieces, in the old design, of surfaces 20 or 22 on the dogs 14 on one side and the transition between surfaces 24 and 70 or 26 and 72 on the other side. Additionally, as the dogs in the prior design moved in radially the contact area while under pulling load between the upper end 66 and the corresponding surface 68 in recess 12 was reduced so that either or both tended to break as the stress concentrated there before the total release of the dogs 14.

In the present invention the metering system 36 becomes disabled when the small diameter portion 58 is all that remains in passage 44. This is calculated to occur before the stress rises to an unacceptable level at the upper end 66 and recess surface 68 or at surface 20 and opposed surface 24 or at surface 22 and opposed surface 26. By disabling the metering system before too much stress builds up, shearing or fracture failures at those loading locations are minimized if not eliminated. Instead what happens is that dogs 14 are rapidly undermined and at worst there is some impact load of the lower end 74 against shoulder 76 or sleeve 16 and preferably against the two of them together as the movement of the sleeve 16 is preferably stopped where it draws up even to shoulder 76.

As an option the mandrel 28 can have a c-ring 78 in a groove 80 and sleeve 17 can have a recess 82. As seen by comparing the FIG. 5 and the FIG. 6 positions, the c-ring 78 that comes up with mandrel 28 lines up with recess 82 and snaps into it locking sleeve 17 to mandrel 28. There is an uphole bias on sleeve 17 that is not shown that basically is disabled when the c-ring 78 snaps into recess 82. Without the locking feature the tool is built to reset as sleeve 17 is pushed by the unseen spring in an uphole direction against sleeve 16 so that surfaces 20 and 22 can again come into alignment with surfaces 24 and 26 for landing in the same or another recess such as 12. However, with sleeve 17 locked in a further downhole position than during run in, the downhole bias on sleeve 16 cannot be offset and such downhole bias ensures that surfaces 20 and 22 stay offset from supporting surfaces 24 and 26 so that the dogs 14 cannot land and stay in another recess such as 12. It should be noted that the uphole bias on sleeve 17 and the downhole bias on sleeve 16 were in the previous design of U.S. Pat. No. 7,284,606 were accomplished respectfully by springs 36 and 40 in that patent that is fully incorporated in this application as if fully set forth.

Figure 7:
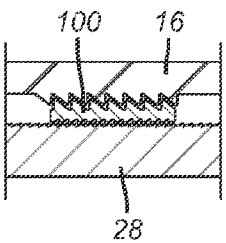
FIG. 7 is an alternative locking device using a body lock ring.

Those skilled in the art can appreciate that variations of the locking concept to prevent the dogs 14 from catching and metering in another groove are possible as alternatives to the c-ring 78 catching in groove 82. One such alternative is a ratchet design or a multi-sided ratchet ring shown in FIG. 7 and known as a body lock ring 100 to name a few alternatives. The change in resistance in the metering system 36 is preferably accomplished with the elongated element having differing diameters 58 and 60 but other techniques can be used to resist flow in passage 44 and then suddenly decrease it or eliminate it. For example, some combination of a fixed orifice and a rupture disc in parallel paths between chambers 38 and 46 can bring about the same result.

It should also be noted that without the locking system for housing 17 that the release of the dogs 14 in the manner described above will bring up housing 17 so that the larger diameter 60 will again be in passage 44 and the dogs 14 will be supported on surfaces 24 and 26 and ready to land in another recess 12 to repeat the metering process.

Note also that section 58 having the smaller cross-sectional area can also be eliminated and flow can be restricted with segment 60 either in or out of passage 44. However, having portion 58 still in the passage 44 when portion 60 comes out allows segment 58 to act as an alignment guide for the elongated member 56 so that if the tool is allowed to reset the member 56 can retain alignment and simply go right back into passage 44 without getting cocked or bent.

While the preferred contact area of surfaces 20 and 22 respectively on surfaces 24 and 26 is at least 50% by area at the time segment 60 exits passage 44, that number can change depending on the material of dogs 14 and mandrel 28 and the geometry of the dogs 14. The objective being that stress is limited to levels that will not cause rapid wear or part destruction from normal operations. The idea being to release the metering system 36 before stresses can concentrate to levels that cause stress cracks or shear off portions of the dogs 14 or supporting structures on the mandrel 28 or the profile 12.

Another optional feature is to provide a pressure relief feature 39 to chamber 38 to prevent overpressure of that chamber if the mandrel 28 is pulled up too fast from the surface. Preferably this pressure relief can be through the wall of the housing 17 and can be in the form of a resettable pressure relief valve (not shown). Of course, setting off this relief device will defeat the metering function as resistance to rapid upward movement of the mandrel 28 will disappear as the dogs 14 move radially inwardly. In that sense the device will revert to operation as in U.S. Pat. No. 7,284,606 until the pressure relief device resets such as when the rapid pulling force on mandrel 28 is relaxed. If there is a lockout feature after a single use then the device will have to be brought out of the hole and be reset before the dogs 14 can engage another groove or the same groove 12 in the wellbore.

As another option to preventing the dogs 14 from re-engaging other grooves after an initial release, which can be in addition to locking sleeve 17 as shown in FIGS. 3 and 6, the dogs 14 themselves can be held retracted by magnetic or band spring 104 or other radially inward oriented force to hold the dogs retracted in recesses 32 and 34. The dogs 14 can be magnetized or have a magnetic strip 102 on their underside or the strip can be in the recesses 34 or 32.

The above description is illustrative of the preferred embodiment and many modifications may be made by those skilled in the art without departing from the invention whose scope is to be determined from the literal and equivalent scope of the claims below.

I claim:

1. A tool adapted to temporarily engage and then release at least one subterranean profile, comprising:

a mandrel for selective support of at least one dog extendable from a housing associated with said mandrel;

said mandrel selectively removing support for said dog, when said dog is extended from said housing into the profile, by virtue of axial relative movement with respect to said dog;

a movement regulation device to retard said axial relative movement until said movement regulation device is defeated, said movement regulation device comprising a passage between fluid reservoirs with a movable member therein where said member leaves said passage open when retarding initial relative movement and said defeat occurring by movement of said member that enlarges the flow area of said passage before enough relative axial movement has occurred sufficient to allow said dog to measurably retract from the profile.

2. The tool of claim 1, wherein:

said movement regulation device, when retarding said relative axial movement, displaces fluid and is defeated by a change in resistance to displacement of said fluid.

3. The tool of claim 2, wherein:

said passage between fluid reservoirs changes in flow area.

4. The tool of claim 3, wherein:

said fluid reservoirs comprise variable volumes;.

5. The tool of claim 4, wherein:

said movable member is displaced in said passage between fluid reservoirs by fluid flowing therethough.

6. The tool of claim 4, wherein:

said movable member between fluid reservoirs has at least two different cross-sectional dimensions along its length and movement of said movable member between fluid reservoirs with respect to said passage between fluid reservoirs removes a larger cross-sectional dimension of said movable member between fluid reservoirs from said passage leaving another portion of said movable member between fluid reservoirs with a smaller cross-sectional dimension in said passage to define defeat of said movement regulation device.

7. The tool of claim 2, wherein:

said change in resistance is accomplished with said movable member with at least a larger and a smaller cross-sectional areas wherein removal of said larger cross-sectional area from said fluid flow passage between fluid reservoirs changes the flow resistance.

8. The tool of claim 2, wherein:

said change in resistance is accomplished with said movable member wherein removal of said movable member from said fluid flow passage between fluid reservoirs changes the flow resistance.

9. The tool of claim 2, further comprising:

a pressure relief device for said fluid to avoid overpressure if said axial relative movement occurs too quickly.

10. The tool of claim 9, further comprising:

said relief device is resettable when pressure against it declines.

11. A tool adapted to temporarily engage and then release at least one subterranean profile, comprising:

a mandrel for selective support of at least one dog extended from a housing associated with said mandrel;

said mandrel selectively removing support for said dog, when said dog is extended from said housing into the profile, by virtue of axial relative movement with respect to said dog;

a movement regulation device to retard said axial relative movement until said movement regulation device is defeated, said defeat occurring before enough relative axial movement has occurred sufficient to allow said dog to measurably retract from the profile;

a lock to prevent under all conditions after said dog is retracted from said profile, while said mandrel remains at a subterranean location, relative movement between said mandrel and said dog from regaining support for said dog from said mandrel, to extend from said housing to be retained by the profile, after said defeat of said movement regulation device.

12. The tool of claim 11, wherein:

said lock comprises a ring on one of said mandrel and said housing and a groove on the other of said mandrel and said housing which lock together upon a predetermined axial relative movement of said mandrel with said housing retained by said dog in the profile.

13. The tool of claim 11, wherein:

said lock comprises a ratchet that allows relative axial movement between said mandrel and said housing in only one direction.

14. The tool of claim 11, wherein:

said lock comprises an applied force on said dog toward said mandrel.

15. The tool of claim 14, wherein:

the source of said force is a spring or a magnet.

16. A tool adapted to temporarily engage and then release at least one subterranean profile, comprising:

a mandrel for selective support of at least one dog extendable from a housing associated with said mandrel;

said mandrel selectively removing support for said dog, when said dog is extended from said housing into the profile, by virtue of axial relative movement with respect to said dog;

a movement regulation device to retard said axial relative movement until said movement regulation device is defeated, said defeat occurring before enough relative axial movement has occurred sufficient to allow said dog to measurably retract from the profile;

said movement regulation device, when retarding said relative axial movement, displaces fluid and is defeated by a change in resistance to displacement of said fluid;

said movement regulation device comprises a fluid flow passage that changes in flow area;

said movement regulation device comprises spaced apart variable volume chambers connected by said flow passage;

said flow passage changes in flow area using a movable member in said flow passage;

said movable member is displaced in said passage by fluid flowing therethough;

said movable member is travel limited by engaging said mandrel.

17. The tool of claim 16, wherein:

said mandrel moves with respect to said passage when said relative axial motion occurs with said dog still engaged in the profile.

18. The tool of claim 17, wherein:

said movable member moves in tandem with said mandrel as fluid displaced through said passage between said chambers, said displacement induced by mandrel movement, keeps said movable member in contact with said mandrel.

19. The tool of claim 18, wherein:

said mandrel has a shoulder and said movable member has a stop ring that rides against said shoulder while said relative axial movement is being retarded.

20. The tool of claim 19, wherein:

said movable member has at least two different cross-sectional dimensions along its length and movement of said movable member with respect to said passage removes a larger cross-sectional dimension of said movable member from said passage leaving another portion of said movable member with a smaller cross-sectional dimension in said passage to define defeat of said movement regulation device.

21. The tool of claim 20, wherein:

said mandrel accelerates its axial movement when said larger cross-sectional dimension exits said passage.

22. The tool of claim 21, wherein:

said mandrel comprises at least one raised surface such that when said raised surface on said mandrel radially aligns with at least one support surface for said dog, said dog is supported in the profile;

said raised surface and support surface still align radially when said axial movement brings said larger cross-sectional area of said movable member out of said passage.

23. The tool of claim 22, wherein:

said raised surface and support surface still axially overlap leaving at least 50% of said support surface in contact with said raised surface when said axial movement brings said larger cross-sectional area of said movable member out of said passage.

24. The tool of claim 22, further comprising:

a lock to prevent said dog from regaining support from said mandrel, to extend from said housing to be retained by the profile, after said defeat of said movement regulation device.

* * * * *